United States Patent [19]

Horst et al.

[11] Patent Number: 5,027,881

[45] Date of Patent: Jul. 2, 1991

[54] CONTINUOUS CASTING APPARATUS

[75] Inventors: Werner S. Horst, 228 Front St., Lititz, Pa. 17543; Hans Horst, Duisburg, Fed. Rep. of Germany

[73] Assignee: Werner S. Horst, Lititz, Pa.

[21] Appl. No.: 629,079

[22] PCT Filed: Apr. 27, 1988

[86] PCT No.: PCT/EP88/00351

§ 371 Date: Oct. 19, 1989

§ 102(e) Date: Oct. 19, 1989

[87] PCT Pub. No.: WO88/08344

PCT Pub. Date: Nov. 3, 1988

Related U.S. Application Data

[63] Continuation of Ser. No. 424,267, filed as PCT EP88/00351 on Apr. 27, 1988, published as WO88/08344 on Nov. 3, 1988, abandoned.

[30] Foreign Application Priority Data

Apr. 28, 1987 [DE] Fed. Rep. of Germany ..... 3714139

[51] Int. Cl.[5] ..... B22D 11/04

[52] U.S. Cl. ..... 164/443; 164/418; 164/421

[58] Field of Search ..... 164/421, 443, 465, 485, 164/418

[56] References Cited

U.S. PATENT DOCUMENTS

| | | | |
|---|---|---|---|
| 2,169,893 | 8/1939 | Crampton et al. | 164/443 X |
| 3,730,251 | 5/1973 | Webbere et al. | 164/485 X |
| 4,665,969 | 5/1987 | Horst et al. | 164/443 X |
| 4,669,529 | 6/1987 | Evertz | 164/443 |
| 4,774,996 | 10/1988 | Ahrens et al. | 164/443 |
| 4,789,021 | 12/1988 | Ahrens | 164/443 X |

FOREIGN PATENT DOCUMENTS

| | | | |
|---|---|---|---|
| 950490 | 8/1982 | U.S.S.R. | 164/421 |
| 1227312 | 4/1971 | United Kingdom . | |

*Primary Examiner*—J. Reed Batten, Jr.
*Attorney, Agent, or Firm*—Haugen and Nikolai

[57] ABSTRACT

A chill mold in a continuous casting apparatus consists of a cast material, which is shrunk onto the cast-in central chill tube as well as the chill tubes which spirally surround the same. Components of the apparatus are re-usable. This is accomplished by a primary and a secondary chill which are offset in the axial direction in relation to each other. Both chills are cooled by separate coolant circuits to their respective chill bodies. The ratio between the length in the continuous casting direction to the external and, respectively, the internal diameter of the primary chill is less than 70:100.

16 Claims, 2 Drawing Sheets

CONTINUOUS CASTING APPARATUS

Figure 1:
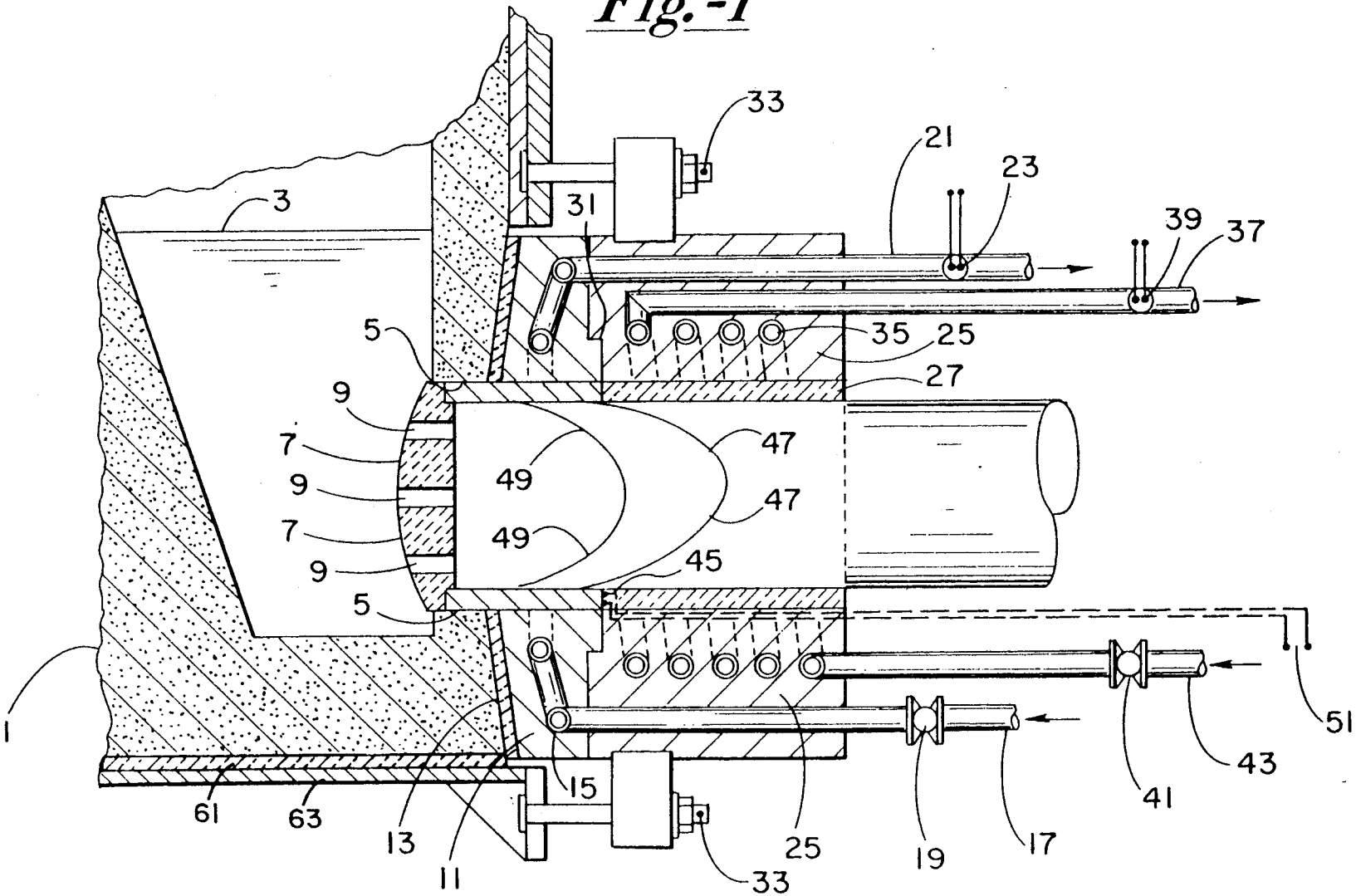

This is a continuation of copending application Ser. No. 07/424,267, filed PCT EP88/00351 on Apr. 27, 1988, published as WO88/08344 on Nov. 3, 1988 and now abandoned.

The present invention relates to a continuous casting apparatus for vertical and/or horizontal operation with a supply member with or without a casting mandril and adapted to be attached to a ladle, and a mold section comprising a central chill tube, said mold section consisting of the central chill tube, the chill spiral and the chill material cast with a shrink fit around the chill tube and the chill spiral.

Conventional continuous casting apparatus comprises a mold which is in the form of a graphite tube or at least has a graphite layer on its inner surface. In order to ensure satisfactory flow of the metal in the hot condition through the apparatus for a furnace keeping the metal hot or from a ladle, conventional molds are usually designed to project into the melt space.

Although this does basically involve the process disadvantage that there is a substantial loss of heat from the furnace, and more especially the material therein to be cast, via the molds, and such amounts of heat then have to transfer via the mold wall to the surrounding chill, the continuous casting apparatus in accordance with the pre-examination European patent specification No. 158 898 has nevertheless become well accepted. Apart from the design, which is divided in the length direction, using a supply member on the ladle and a cooling mold which adjoins the supply part in the direction of casting and may have its temperature adjusted, this known continuous casting apparatus has the significant advantage, which is of decisive importance in comparing it with other known apparatus, that the cooling mold is made of a cast material, which surrounds the cast-in-place central cooling tube with a shrink fit and which surrounds the spiral cooling tube which fits around the central cooling tube and has the coolant flowing through it.

A two-piece mold, for instance, is described in the pre-examination German specification No. 2,058,051 and the German U1 specification No. 1,854,884. In both cases, a mold is described which is divided in the longitudinal direction, the first mentioned specification having the cooling device, which follows on the intake part, subdivided into two different zones, which differ from each other as regards the use of different materials on the inner central cooling tube. The part of the central cooling tube which is far and away larger and longer is however in this specification also said to be made of graphite, for which reason the initially mentioned disadvantages are still to be found and still occur.

A continuous casting mold with a primary and a secondary chill is mentioned in "Soviet Inventions Illustrated", Section CH, Week K46, 28.12.1983, Derwent Publications Ltd. (London, GB)-Abstract No. 819 305, class M22 and Soviet pre-examination specification No. 990,441, 23.01.1983 (D1). In view of the conically overlapping arrangement between the primary and secondary chills and owing to the change in the internal diameter from the primary to the secondary mold, this mold divided into two parts is in many ways not suitable for practical operation. A further point is that in the overlapping conical arrangement of the primary and secondary chills there is a high rate of heat loss even in the primary chill.

A continuous casting mold with a division into two parts is lastly also described in the British pre-examination specification No. 1,227,312, in which the secondary chill is made of copper or an alloy thereof, that is to say of a material which is harder than graphite. In this case the primary and secondary chills surround a chill device in the form of cooling tubes placed transversely in relation to the longitudinal direction of the mold.

Taking this prior art as a starting point, one object of the present invention is to devise a continuous casting mold, which while having low production and operating costs involves an improvement in the quality of the continuously cast material as compared with the quality obtainable with conventional continuous casting plant.

In order to achieve this or other objects appearing herein, in addition to the supply member there are a primary and a secondary chill placed with an offset in the axial direction in relation to each other. The primary and the secondary chills are provided with a separate coolant circuit in their chill bodies, and the ratio of the length in the direction of continuous casting to the internal diameter of the primary chill is less than 60:100. The central chill tube of the secondary chill extends for a greater length than the primary chill and consists at least on the inner face of graphite-free material, whose hardness is greater than that of graphite.

Thus the present invention provides a continuous casting apparatus in which the relatively short axial length of primary chill and the comparatively large internal diameter in conjunction with the secondary cooler lead to particularly satisfactory continuous casting performances.

It is only in conjunction with this short design of the primary chill that the following secondary chill, having a very much greater axial length leads to an optimum, controlled cooling of the continuously cast ingot while avoiding the use of graphite for the central cooling tube. Furthermore, the use of a known cooling spiral is also important, just like having the feature of the European pre-examination specification No. 158 898 to the effect that the central tube and the cooling spiral have the metal of the chill cast onto them with a shrink fit. It is only in this way that is possible to achieve the heat transmission coefficients required.

In the case of the preferred design, the tubular supply member anchored to the crucible may extend as far as the secondary chill, with the extremely short primary chill only surrounding the lower section of the tubular supply member directly adjacent to and short of the secondary chill. This front supply member may be made of high quality graphite with a high thermal conductivity and not being soluble in the melt. This short length means that the graphite costs for this wearing component are kept very low. Owing to the systematic control of the cooling temperature, it is possible for the wall temperature of this short primary chill to be set so high that there is complete marginal solidification over the full periphery of the cast metal without there being a marked shrinkage.

In addition to these cost savings, the short length of the disk-like primary chill surrounding the tubular supply member means that far less heat is taken from the chill mold than is the case with known designs.

A further advantage achieved is that in the short hot supply member, there will always be a sufficient input flow of hot metal to the chill device so that gases dissolved in the melt and released during solidification may escape in a counterflow direction without the metal temperature of the melt and thus the gas content thereof has to be increased, something that would be a disadvantage.

The greater part of the chill mold, namely the secondary chill is designed as a reusable component. It is a particular advantage in this respect that in the case of the continuous casting apparatus of the present invention, it is possible to do without graphite in the greater part of the length of the secondary chill. This means that there are no extreme costs and in addition one may be certain of the possibility of reusing the secondary chill.

A material which is more particularly suitable for the central chill tube in the secondary chill is a carbide compound, more especially silicon carbide. The use of aluminum or an Al alloy, which surrounds in a shrunk on manner both the inner central chill tube, preferably made of silicon carbide, and also the cooling loops, leads to an optimum thermal conductivity and cooling action. Furthermore, such a mold is extremely light in weight and thus readily handled.

The use of the above-mentioned special silicon carbide, which while having an extremely high hardness has a low coefficient of thermal expansion. This means that it is also possible to have a high surface quality on the mold wall with a surface roughness of for instance 2 to 5 microns. This means that the cast material moving in this central chill tube, and which initially is only solidified at the margin, will only meet with a very slight frictional resistance.

This fact and the great hardness of the material mean that no patches obstructing the transfer of heat may be formed in the central chill tube. A radiation coefficient close to that of a "black body" means that there is a constant, high heat transfer and heat exchange between the hot cast material moving through the apparatus and only solidified at the margin and the secondary chill without the cast material being excessively quenched, this not being desired. Such excessive quenching would lead to a tendency to chill in the external cast skin, more especially when teeming cast iron.

The continuous casting apparatus in accordance with the present invention furthermore makes it possible to increase the casting rate by more than 30% over that of conventional continuous casting apparatus. In this respect, the continuous casting apparatus in accordance with the invention is suitable both for the horizontal and also for vertical operation. It more especially makes it possible to carry out a continuous casting operation, it being however naturally suitable for discontinuous operation as well. It is especially in this case that the special advantages of the invention are to be seen in the use of a highly wear-resistant, extremely hard and polishable material, such as ceramic material for the inner central chill, which material has a high thermal conductivity and is resistant to thermal shock. Such material may in many cases be used without the otherwise necessary finishing of the inner face of the casting mold. The wear, which is otherwise substantial, of graphite molds in the case of discontinuous casting is diminished to a striking degree.

The reliable supporting and guiding effect of the cast material further solidifying in the secondary chill means that the latter is protected against bending and mechanical loads and it is also reliably guided and centered in the primary chill zone as well. This, in turn, leads to an even and central primary solidification and prevents uneven wear of the sensitive soft primary graphite mold. This is particularly significant in the case of a horizontal continuous casting apparatus as well.

Further advantages, details and features of the invention will be seen from the following working embodiments represented in the drawings FIG. 1 shows a first working example of a continuous casting apparatus in accordance with the invention for the horizontal continuous casting of round bars.

Figure 2:
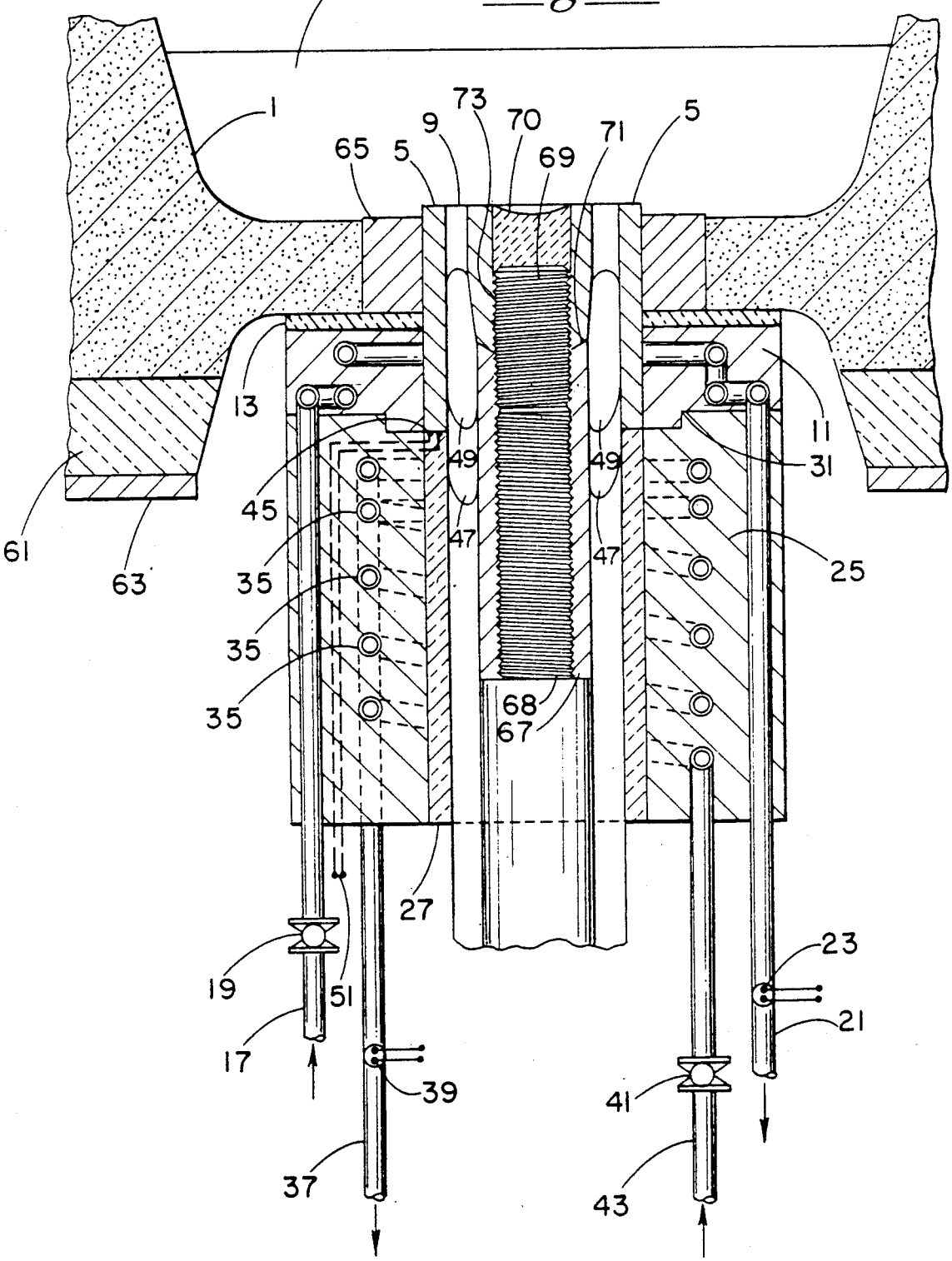

FIG. 2 shows a further working embodiment of a continuous casting apparatus in accordance with the invention, more especially suited to the vertical continuous casting of tubes of metal and more especially of heavy metal alloys.

In what follows, reference will be more particularly had to FIG. 1, in which a continuous casting apparatus for horizontal operation is shown in a diagrammatic longitudinal section. In this figure, 1 denotes the floor and side walls of a furnace for keeping metal at the required temperature and which contains a melt 3. In one end wall of the furnace there is a supply member 5 of the continuous casting apparatus which extends into the interior thereof and whose opening is provided in a conventional manner with an inset 7 of refractory material which is not soluble in the melt and which contains passages 9.

The opposite end remote from the inset 7 in the direction of casting of the supply member 5 is fitted into a conical or cylindrical seat of a primary chill 11, like a cooling ring. 13 denotes a heat isolation ring, which is seated between the furnace wall 1 and the primary chill 11 in the form of thermal insulation. Cooling itself takes place by means of a cooling or chill spiral 15 provided in the primary chill 11.

The amount of water needed for cooling is adjusted by means of an adjustable valve 19 arranged in the supply pipe 17 of the cooling spiral 15, such valve 19 being set and operated by means of a thermosensor 23 provided in the outlet tube 21 in a known manner, such sensor being responsive to the temperature of the emerging heated cooling water.

As will be seen from the drawing, the primary chill 11, designed in the form of a chill ring, is mounted with only a short length on the end of the supply member 5 directly upstream from the next following secondary chill 25. A favorable ratio between the length of this cooled primary chill 11 or supply member 5 which is pressed into the surrounding metal chill, to the external diameter of the cast ingot may be for instance less than 70:100 or less than 60:100, 50:100, 40:100 or 35:100. The above mentioned values for the ratio thus also apply equally in principle if the length of the primary chill 11 is related to the internal diameter of which is the same as the external diameter of the cast material shrinkage factor.

The material used for the supply member 5 will, as a rule, be graphite with a good thermal conductivity and which is not soluble in the melt. The use of boron nitride is also possible.

Owing to the relatively short length of the cooled supply member 5 the temperature of the foremost part projecting into the ladle of the supply member 5 only amounts to approximately 60 to 110 C. less than the temperature of the temperature range in the melt 3. This leads to the advantage that the melt accordingly loses only a small amount of heat. The extreme ratio of the small length of the primary chill to the diameter thereof. Upon entry into the primary chill, leads to a high temperature of at least 550° to 600 C. at the inlet of the primary chill 11 and of less than 200 C. at the end of the chill. The wall temperature of the short primary chill is not so high that there is a complete marginal solidification in this front part of the primary chill around the full periphery of the cast material, but neither is there any pronounced shrinkage.

In FIG. 1 it will be seen that the chill disk 11 is in the form of a shallow cone. It is made of metal with a high thermal conductivity or a metal alloy also having a high thermal conductivity, for example, copper containing between 0.5 to 0.7% of Si and 1% to 1.2% of Ni, that is to say a hardenable, refractory copper alloy. Deformation of this primary chill disk 11 is practically out of the question, owing to its specially compact form. The cast-in chill spirals 15 mean that there is no need for expensive machining to produce cooling ducts as is the case with standard chills. Furthermore, otherwise necessary welding or brazing is no longer needed.

The secondary chill 25 adjoins the primary chill 11 as already mentioned. The internal central chill tube 27 of the secondary chill is made of ceramic material with a high thermal conductivity.

The central chill tube 27 is surrounded by the secondary chill 25, which may be made of metal with a high thermal conductivity, as for instance, aluminum or an alloy thereof. This central chill tube 27 is joined to the supply member 5 by means of a closely fitting seat 31 and a locking bolt 33 so that there is a sealing joint, although it may be readily removed when desired. In this respect, the chill or cooling tubes 17 and 21 of the primary coolant circuit are so arranged to extend in an axial direction through the chill 25 so that in the primary chill 11, they merge with the chill or cooling spirals 15 therein.

The chill spiral 35 of the secondary chill 25 consists of ceramic material like the inner central chill tube 27, and is also connected in a thermally conducting manner by the shrunk-on metal of the chill 25 surrounding both of them. The regulation of the temperature of the secondary chill 25 is ensured by a further thermosensor 39 located in the outlet tube 37 and which operates the regulating valve 41 in the supply tube 43 of the secondary chill 25.

Number 45 denotes a thermoelement, which is installed between the inner wall of the chill 25 and the ceramic chill tube 27 a short distance to the rear of the joint between the supply member 5 and the secondary chill 25. This thermoelement 45 means that the casting speed, that is to say the motion of the cast material and its speed, is so controlled as to ensure that marginal solidification of the cast material in the supply member 5 is completed. In order to make clear the function of this thermoelement, FIG. 1 diagrammatically indicates the position of the liquid/solid phase limit and, respectively, the liquid/solid line. In this case 47 denotes the position of the phase limit after termination of the driving phase, while the line 49 denotes the distance moved by the solidification front during the stop period towards the furnace.

By way of the regulation of the draw-off speed, the thermoelement 45 effects a limitation of the phase limit at the level of the connection, or shortly before it, between the supply member 5 and the secondary chill 25. For this purpose, the thermoelement 45 operates a pick-up marked 51 in the FIG. 1. If the thermosensor 45 indicates an increasing temperature above a set value owing to the shift in the phase limit, then via the pick-up 51, the casting speed is decreased so that the temperature measured at the thermoelement 45 goes down again. The production of the secondary chill by simultaneous casting around the internal ceramic central chill tube 27 and the chill spiral 35 is particularly economic as regards costs and rational. After casting in position, the internal central chill tube 27 forms a firm permanent shrink-on joint with the surrounding metal of the secondary chill 25, the inner cooling surface of the joint not having to be machined. It is more especially the use of ceramic materials with a high thermal conductivity, as for instance silicon carbide, which has proved to be particularly promising. Materials such as special purpose silicon carbide have high thermal conductivity and a low thermal expansion with a high resistance to thermal shock and resistance to aging. They are extremely hard and polishable. Additional floor insulation 61, and sheet metal 63 is also provided.

In what follows, an account will be given of a further example of the invention with reference to FIG. 2, the same reference numerals therein as used in FIG. 1 denoting like parts.

The working embodiment of the invention to be seen in FIG. 2 relates to a vertical continuous casting apparatus more for heavy metal alloys.

The entire furnace may be protected by additional floor insulation 61 and a sheet metal floor part 63.

The supply member in this form of the invention is the floor 1 of the furnace by way of a fitting 65. The fitting 65 rests on the primary chill 11 like a chill ring and on the heat isolation ring 13 provided here. In this form of the invention, 67 denotes a hollow casting mandril preferably made of graphite which is held in place by means of a first plug 69, also consisting of graphite, and centering means 71 to be held precisely in the center of the supply member 5. A second plug 70 made of refractory cement, prevents the direct flow of heat from the melt to the casting mandril and prevents possible leakage of melt through the thread 73 on plug 69 into the interior 68 of the casting mandril 67.

It has been stated above that ceramic materials are preferred for the central chill tube. Ceramics to be recommended are more especially carbides or carbide compounds. Covalent carbides used are as a rule only boron and silicon carbides, which are hard, difficult to melt and chemically inert. Most metallic carbides are non-stoichiometric compounds with an alloy character. They are resistant to alloys and are, as a rule, harder than the pure metallic components and conduct electricity. The industrially important ones are the carbides of chromium, tungsten, hafnium, molybdenum, vanadium, niobium and titanium.

This invention has been described herein in considerable detail in order to comply with the Patent Statutes and to provide those skilled in the art with the information needed to apply the novel principles and to construct and use such specialized components as are required. However, it is to be understood that the invention can be carried out by specifically different equipment and devices, and that various modifications, both as to the equipment details and operating procedures, can be accomplished without departing from the scope of the invention itself.

We claim:

1. A continuous casting apparatus for casting material having a draw-off rate wherein the continuous casting apparatus comprises:

a tubular supply member having an internal surface, a first inside diameter, a loading end, and an output end, wherein the supply member is disposed to receive the material at the loading end;

a chill tube having an internal surface, a second inside diameter, an input end connected to the output end of the supply member such that material from the supply member can flow into the chill tube, and a discharge end;

a primary chill having a third inside diameter and having a first length less than 70% of the third inside diameter and cast with a shrink fit around the supply member wherein the primary chill also has a first chill spiral for cooling the supply member, and wherein the first chill spiral cools the primary chill such that heat is removed from the supply member substantially to maintain the material at a first predetermined temperature profile; and a second chill having a second length greater than the first length and cast with a shrink fit around said chill tube wherein the secondary chill also has a second chill spiral for cooling the chill tube, and wherein the second chill spiral cools the secondary chill such that heat is removed from the chill tube substantially to maintain the material at a second predetermined temperature profile.

2. The apparatus of claim 1 wherein the first chill spiral comprises a first coolant spiral passage cast within and surrounding the primary chill to form a coolant tube, the first coolant spiral passage having a first coolant inlet for receiving a first coolant and a first coolant outlet for discharging the first coolant, and wherein the first coolant has a first coolant flow rate.

3. The apparatus of claim 1 wherein the second chill spiral comprises a second coolant spiral passage cast within and surrounding the secondary chill to form a plurality of spiralling coolant tubes, the second coolant spiral passage having a second coolant inlet for receiving a second coolant and a second coolant outlet for discharging the second coolant, and wherein the second coolant has a second coolant flow rate.

4. The apparatus of claim 1 wherein the chill tube internal surface comprises a graphite-free material having a hardness greater than that of graphite.

5. The apparatus of claim 1 wherein the supply member internal surface is composed substantially of material selected from the group consisting of boron nitride and graphite.

6. The apparatus of claim 1 wherein the supply member and chill tube are adjacent forming a joint between the supply member and chill tube.

7. The apparatus of claim 1 wherein the ratio of the first length to the third inside diameter is less than 50:100.

8. The apparatus of claim 1 wherein the ratio of the first length to the third inside diameter is less than 60:100.

9. The apparatus of claim 1 wherein the chill tube is composed substantially of a material which is selected from the group consisting of carbon, a carbide compound, silicon carbide and a ceramic compound.

10. The apparatus of claim 3 wherein the plurality of spiralling coolant tubes extends the length of the secondary chill.

11. The apparatus of claim 1 wherein the chill tube is composed of an extremely hard material resistant to shock with a low thermal expansion.

12. The apparatus of claim 2 wherein the first coolant spiral passage also comprises a first thermosensor for controlling a regulating valve regulating the first coolant flow rate to maintain the first predetermined temperature profile.

13. The apparatus of claim 3 wherein the second coolant spiral passage also comprises a second thermosensor for controlling a regulating valve regulating the second coolant flow rate to maintain the second predetermined temperature profile.

14. The apparatus of claim 12 wherein the first thermosensor is located at the first coolant outlet.

15. The apparatus of claim 13 wherein the second thermosensor is located at the second coolant outlet.

16. The apparatus of claim 6 wherein the joint between the supply member and chill tube also comprises a third thermosensor for controlling the draw-off rate.

* * * * *